US010557608B2

(12) United States Patent
Puech et al.

(10) Patent No.: US 10,557,608 B2
(45) Date of Patent: Feb. 11, 2020

(54) LUMINOUS LIGHTING AND/OR SIGNALING MODULE OF AN AUTOMOTIVE VEHICLE

(71) Applicant: Valeo Vision, Bobigny (FR)

(72) Inventors: Delphine Puech, Courbevoie (FR); Kostadin Beev, Emerainville (FR); Antoine de Lamberterie, Paris (FR); Eric Stefura, Saint-Maur-des-Fosses (FR); Marine Courcier, Paris (FR); Paul Jacquemin, Paris (FR)

(73) Assignee: Valeo Vision, Bobigny (FR)

( * ) Notice: Subject to any disclaimer, the term of this patent is extended or adjusted under 35 U.S.C. 154(b) by 494 days.

(21) Appl. No.: 14/867,293

(22) Filed: Sep. 28, 2015

(65) Prior Publication Data

US 2016/0091159 A1 Mar. 31, 2016

(30) Foreign Application Priority Data

Sep. 30, 2014 (FR) ..... 14 59268

(51) Int. Cl.
*F21S 41/16* (2018.01)

(52) U.S. Cl.
CPC ..... *F21S 41/16* (2018.01)

(58) Field of Classification Search
CPC .. F21S 48/125; F21S 48/1145; F21S 48/1159; F21S 48/1208; F21S 48/1241; F21S 48/1305; F21S 48/1388; F21S 48/145; F21S 48/1747; F21S 48/1109; F21S 41/16; F21S 41/176; F21S 41/14; F21S 41/675; F21Y 2115/30; F21Y 2101/00
USPC ..... 362/509
See application file for complete search history.

(56) References Cited

U.S. PATENT DOCUMENTS

| | | | | |
|---|---|---|---|---|
| 7,500,773 | B2 | 3/2009 | Komatsu | |
| 7,524,094 | B2 | 4/2009 | Fukawa et al. | |
| 7,731,402 | B2 * | 6/2010 | Tessnow | F21S 41/143 362/545 |
| 9,157,595 | B2 | 10/2015 | Hager et al. | |
| 2007/0070638 | A1 | 3/2007 | Fukawa et al. | |
| 2007/0201241 | A1 | 8/2007 | Komatsu | |
| 2013/0194816 | A1 | 8/2013 | Hager et al. | |
| 2014/0321141 | A1 | 10/2014 | Bauer et al. | |

FOREIGN PATENT DOCUMENTS

| | | | |
|---|---|---|---|
| DE | 102004060475 | A1 | 7/2006 |
| DE | 102006042749 | A1 | 3/2007 |
| DE | 102008036192 | A1 | 2/2010 |
| DE | 102010041096 | A1 | 3/2012 |
| DE | 102012212244 | A1 | 1/2014 |
| EP | 2390561 | A1 | 11/2011 |
| WO | 2011045103 | A1 | 4/2011 |
| WO | 2013075157 | A1 | 5/2013 |

* cited by examiner

*Primary Examiner* — Bao Q Truong
*Assistant Examiner* — Jessica M Apenteng
(74) *Attorney, Agent, or Firm* — Oblon, McClelland, Maier & Neustadt, L.L.P.

(57) ABSTRACT

A luminous lighting and/or signaling module for an automotive vehicle, the module comprising first means arranged to produce a first cut-off beam and second means arranged to produce at least two selectively activatable luminous segments, the luminous segments forming a second beam that is complementary to the cut-off beam, when they are activated simultaneously.

20 Claims, 3 Drawing Sheets

LUMINOUS LIGHTING AND/OR SIGNALING MODULE OF AN AUTOMOTIVE VEHICLE

CROSS-REFERENCE TO RELATED APPLICATIONS

This application claims priority to the French application 1459268 filed on Sep. 30, 2014, which application is incorporated herein by reference and made a part hereof.

BACKGROUND OF THE INVENTION

1. Field of the Invention

The invention relates to the field of lighting and/or signaling and especially automotive vehicle lighting and/or signaling. More particularly, the invention relates to a lighting and/or signaling module for an automotive vehicle.

2. Description of the Related Art

Automotive vehicles are equipped with headlamps, or headlights, intended to illuminate the road in front of the vehicle at night or in case of low visibility. These headlamps may generally be used in one of two lighting modes: a first "high beam" mode and a second "low beam" mode. The "high beam" mode allows the road far in front of the vehicle to be brightly lit. The "low beam" mode delivers more limited lighting of the road, but nevertheless provides a good visibility without dazzling other road users. These two lighting modes are complementary, and one or the other is selected depending on traffic conditions. The switch from one mode to the other may be activated manually, the driver deciding the moment at which the switch occurs, or it may be activated automatically, depending on the detection by suitable means of the conditions required for such a change of lighting mode.

As regards the switch from "low beam" to "high beam", headlamps are known in which a luminous module integrates a movable mechanical element provided to participate in the formation of such or such a beam on request from the driver or the associated control system. Document DE 10 2006 042 749, which is equivalent to U.S. Patent Publication 2007/0070638, which is issued as U.S. Pat. No. 7,524,094, discloses a lighting device for a vehicle headlamp comprising an LED light source and an elliptical reflector in a half-space with two focal points. The LED source is placed at the first focal point of the reflector near the latter. The light emitted by the LED source is reflected by the reflector towards the second focal point where a reflective surface referred to as a deflector is positioned. This reflective surface comprises an edge on the reflector side and an edge on the side opposite the reflector. These edges are what are called "cut-off edges". One portion of the light beam reflected by the reflector strikes the reflective surface and is reflected depending on its angle of incidence on the surface. Another portion of the light beam passes by the cut-off edge(s) and is not deviated by the reflective surface. The cut-off edge thus defines a boundary between that portion of the beam which is reflected and therefore deviated and the non-reflected portion. A lens is positioned behind the reflective surface so that its focal point corresponds to that of the elliptical reflector. The reflective surface with its one or more cut-off edges is called a deflector insofar as it deviates or "deflects" one portion of the beam with a view to forming a cut-off in the beam emitted by the lens. The deflector is movable along an axis parallel to the optical axis of the reflector. This mobility makes it possible to provide the "high beam" function and the "low beam" function. It will be understood that headlamps of this type require internal to the module a mechanical system that must be of high precision and that involves a substantial manufacturing cost Moreover, there is a need, in the automotive field, to be able to illuminate the road in front of the vehicle in a "partial road lighting mode", namely to generate in a high beam one or more dark areas corresponding to the locations of vehicles coming in the opposite direction or vehicles driving in front, so as to avoid dazzling other drivers while illuminating as much as possible of the road. Such a function is called an adaptive driving beam (ADB) or even "selective beam" function. Such an ADB function is intended to automatically detect a road user liable to be dazzled by a lighting beam emitted in high beam mode by a headlamp, and to modify the outline of this lighting beam so as to create a zone of shadow in the location of the detected user. The advantages of the ADB function are multiple: improved user comfort, better visibility relative to a low beam lighting mode, higher reliability mode changing, much lower risk of dazzle and safer driving conditions.

SUMMARY OF THE INVENTION

The invention falls within this double context of a presence of what is called a "selective beam" function on the one hand, and of a "low beam" and "high beam" mode complementarity on the other hand, the invention having the objective of providing an automotive vehicle headlamp that, while being more compact and costing less, provides lighting and/or signaling functions that are at least as effective as prior modules or headlamps.

With this aim, one subject of the invention is a luminous module comprising first means arranged to produce a cut-off beam and second means arranged to produce at least two selectively activatable luminous segments, the luminous segments forming a beam that is complementary to the cut-off beam, when they are activated simultaneously.

Advantageously, the first and second means are arranged so as to shape the beams output from the module. The first means may be arranged so that the cut-off of the cut-off beam is generally horizontal, and the second means may be arranged so that each luminous segment has at least one vertical edge. It is particularly advantageous for the module to be arranged so that the luminous segments are superposed on the generally horizontal cut-off of the cut-off beam, or indeed so that they partially overlap this cut-off.

According to various features of the invention, implementable individually or in combination:

- a projecting device, comprising a focal zone, and especially a focal plane, may be placed on the path of the beams; the projecting device may especially comprise one or more lenses and/or one or more reflectors;
- the first means consist of a first submodule arranged to produce a low beam, especially comprising an oblique cut-off portion: provision will possibly be made as a variant for the cut-off to be devoid of oblique cut-off portion, in order to be entirely plane, or even to contain a vertical step;
- the first submodule comprises an optical element and at least one first light source, the optical element being able to deviate toward the projecting device projecting rays emitted by the first light source; the optical element comprises at least one concave reflector portion of generally ellipsoidal shape having at least a first focal point and a point of focus, the first light source being placed at the first focal point so that most of the light rays emitted by the first light source are reflected by the reflector portion in the vicinity of the point of focus:

provision will possibly be made for the optical element to comprise a plurality of concave reflector portions of generally ellipsoidal shape each having a first focal point and a point of focus;

the first submodule furthermore comprises an especially reflective shield forming a means for cutting off the beam of rays emitted by the light source; the shield comprises an edge placed in the focal zone of the projecting device, the edge being borne by a ridge of the shield joining the upper and lower faces of the shield; the edge is located at the point of focus of the reflector portion of the first submodule: if needs be, when provision has been made for an optical element comprising a plurality of reflector portions, the cut-off edge advantageously passes through all the points of focus of all the reflector portions of the first submodule.

the edge has a curved profile, especially having a step shape substantially at the center of the cut-off edge: the step-shaped curved profile may for example have two right portions offset one relative to the other by a riser located in the central portion of this cut-off edge, in order to form, in association with the rays reflected by the reflector of the first submodule, the low beam having an oblique cut-off portion.

the second means consist of a second submodule in which at least two selectively activatable second light sources are able to emit, simultaneously or alternatively, light rays: for example, each second light source is able to emit light rays intended to form a luminous segment, the set of luminous segments formed by the two sources forming the complementary second beam.

the second submodule comprises complementary means arranged to interact with the second light sources so as to form images of these sources level with the focal zone of the projecting device, these images being intended to be projected by the projecting device in order to form the luminous segments; the complementary means are arranged so that the images have edges placed so as to be adjacent to the cut-off edge: the complementary means are therefore arranged so that each luminous segment has at least one, especially lower, edge, the profile of which is complementary to one portion of the profile of the cut-off of the cut-off beam.

the complementary means are placed so as to make contact with the shield; provision may advantageously be made in this case for the complementary means to make contact with the shield only and uniquely in the vicinity of the focal zone.

According to a series of features of one embodiment of the invention, the complementary means may comprise a plate bearing a luminescent material and the second light sources are then oriented so as to light the luminescent material borne by the plate: the expression "luminescent material" is here understood to mean a material capable of scattering light and at the same time of carrying out a photoluminescence, for example fluorescence or phosphorescence, operation, in order to convert some of the radiation emitted by the source into radiation located in another wavelength range in such a way that mixing of the original radiation and the converted radiation yields a white color. By way of nonlimiting example, a diode emitting blue light and a phosphor re-emitting yellow radiation may be used, the combination of these two colors yielding a white color. Moreover, the second light sources may be laser diodes. As a variant, the second light sources may be light-emitting diodes equipped with collimating optics.

The plate may be a glass plate into which are integrated phosphor blocks, the second light sources being targeted on the phosphor blocks; the plate bearing the luminescent material may be placed in the focal zone; the plate has an edge the profile of which is complementary to the profile of the edge of the shield, the luminescent material borne by the plate being adjacent to the curved profile of the edge of the shield.

According to another series of features, the complementary means may comprise optical guides that are respectively associated with one of the second light sources, each optical guide having an entrance face and an exit face so as to guide the light emitted by the associated second light source from the entrance face to the exit face: by way of example, each light source may be formed by one or more light-emitting semiconductor chips, this or these chip(s) being placed facing the entrance face of the associated optical guide; each optical guide may be arranged to form an image of the associated second light source level with the exit face of this guide, this exit face being placed level with the focal zone of the projecting device; the exit face of each optical guide may be arranged in order to make contact with the shield, the ridge of contact between each exit face and the shield being in the focal zone; each optical guide may comprise a lower face and an upper face that extend between the ends of the entrance face and of the exit face, the lower face being turned away from the shield whereas the upper face is turned toward the shield, the lower face being a reflective face, for example having a substantially elliptical shape a first focal point of which coincides with the location of the second light source and a second focal point of which is located level with the exit face: for example, the reflective lower face has a cross-section the profile of which is at least partially substantially elliptical; the second focal point of the reflective face is located level with the ridge where the upper face and exit face meet, at the point of contact with the shield.

Advantageously, the optical guides are placed so that their respective downstream portions, which bear the exit face, are contiguous one against the other and so that their respective upstream portions, which bear the entrance face, are spaced transversely one from the other. For example, the optical guides will possibly be placed in series in a fanned arrangement.

According to various features, implementable individually or in combination, provision will possibly be made for the set of guides to be produced from one and only one part. Or indeed each of the optical guides may be produced individually and the guides are mounted one relative to the other, especially by adhesive bonding level with their downstream portion. In both cases, the downstream portions of two adjacent optical guides join upstream of the focal zone, in order to form a common zone of overlap of the images formed by each guide. Thus, the common zone of the guides extends from a junction zone upstream of the focal zone as far as the exit face, level with the focal zone.

Provision will possibly be made for the optical guides to be mounted on a fastening holder borne by the shield. For example, provision will possibly be made for the transverse ends of the fastening holder to be fastened to the transverse ends of the shield.

The optical guides may be made of a material allowing light rays to propagate by internal reflection from the entrance face to the exit face, for example of polycarbonate (PC) or polymethyl methacrylate (PMMA) or silicone or glass.

According to various features of the invention, the luminous module advantageously comprises first means arranged to produce a cut-off beam and second means arranged to produce at least two selectively activatable luminous segments; the first and second light sources corresponding to the first and second means may be placed on a common holder that extends between the two submodules; this common holder then consists of a means for thermally cooling the light sources, the first and second light sources being placed on either side of the common holder; the first and second light sources are respectively associated with a printed circuit board, the common holder bearing the printed circuit boards; the first and second light sources are directly mounted on the thermally cooling means: the expression "directly mounted" is understood to mean that the light sources are mounted without a printed circuit board intermediate.

Provision will possibly be made for the complementary means such as they were described above to be placed at a distance from the shield, and for these complementary means to then possibly comprise a lens or a reflector.

According to the invention, it is advantageous for the two submodules to be placed in the same housing.

The invention also relates to a lighting system comprising at least one module such as described above and control means for turning on, turning off or modifying the luminous power emitted by the first means and the second means of the luminous module. The same control means may control the first and second means of the module.

The lighting system may furthermore comprise a module for detecting on the road a body not to be dazzled, the detecting module being able to transmit detection information to the control means that turn on, turn off or modify the luminous power emitted by at least the second means depending on this detection information.

Advantageously, the control means of the lighting system are arranged, when a body not to be dazzled is detected by the detecting module, to turn on or increase or leave turned on the first means so that the cut-off beam lights the road, to turn off or decrease or leave turned off the second means, the luminous segments of which could dazzle the body not to be dazzled, and to turn on or increase or leave turned on the second means, the luminous segments of which will not dazzle the body not to be dazzled.

Provision may advantageously be made for a lighting system of this type with at least two modules, one of the modules being placed in a left headlamp, the other module being placed in a right headlamp; the modules are arranged relative to each other so that at least one segment produced by one of the modules overlaps at least one segment produced by the other of the modules.

Other features and advantages of the present invention will become more clearly apparent from the description and drawings, in which:

BRIEF DESCRIPTION OF THE ACCOMPANYING DRAWINGS

DETAILED DESCRIPTION OF THE PREFERRED EMBODIMENTS

A luminous lighting and/or signaling module of an automotive vehicle comprises according to the invention first means 2 (FIG. 1) arranged to produce a cut-off beam, an optical projecting device 4 (FIG. 7) placed on the path of this beam, at the exit of the module, and second means 6 (FIG. 1) arranged to produce a beam that is complementary to the cut-off beam, when the first means 2 and the second means 6 are simultaneously activated.

Figure 7:
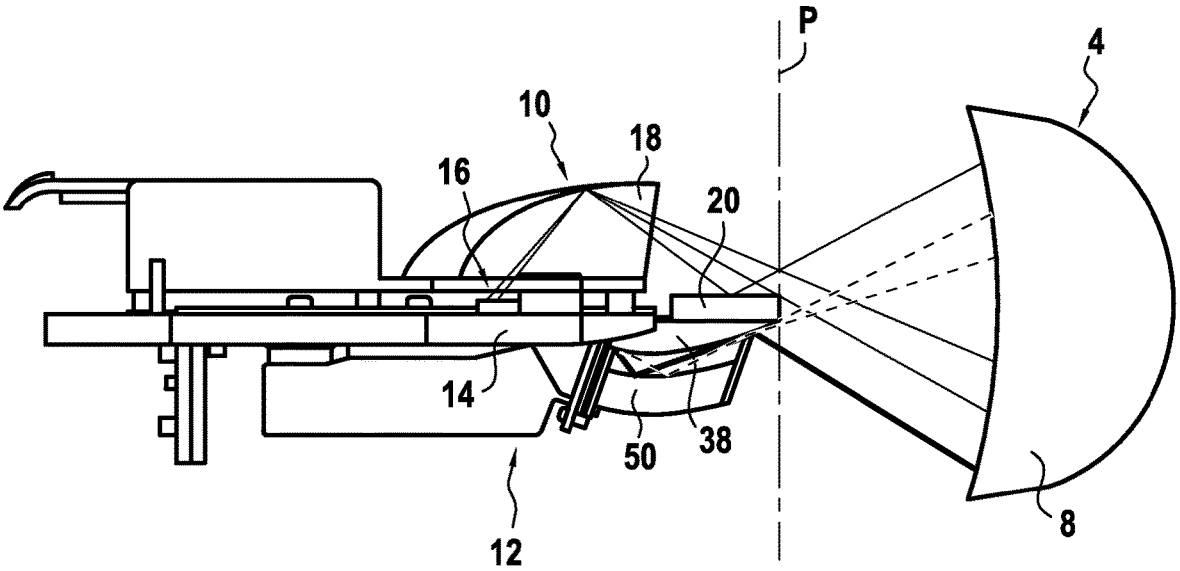
FIG. 7 is a side view similar to that in FIG. 1, in which the projecting device is shown, and the path of the light rays emitted by the light sources.

An exemplary optical projecting device 4 is illustrated in FIG. 7. It is here a question of a lens 8 placed axially upstream of the first and second means 2, 6. It will be understood that the optical projecting device 4 will possibly moreover take other known forms, and for example consist of one or more lenses and/or one or more reflectors.

Figure 1:
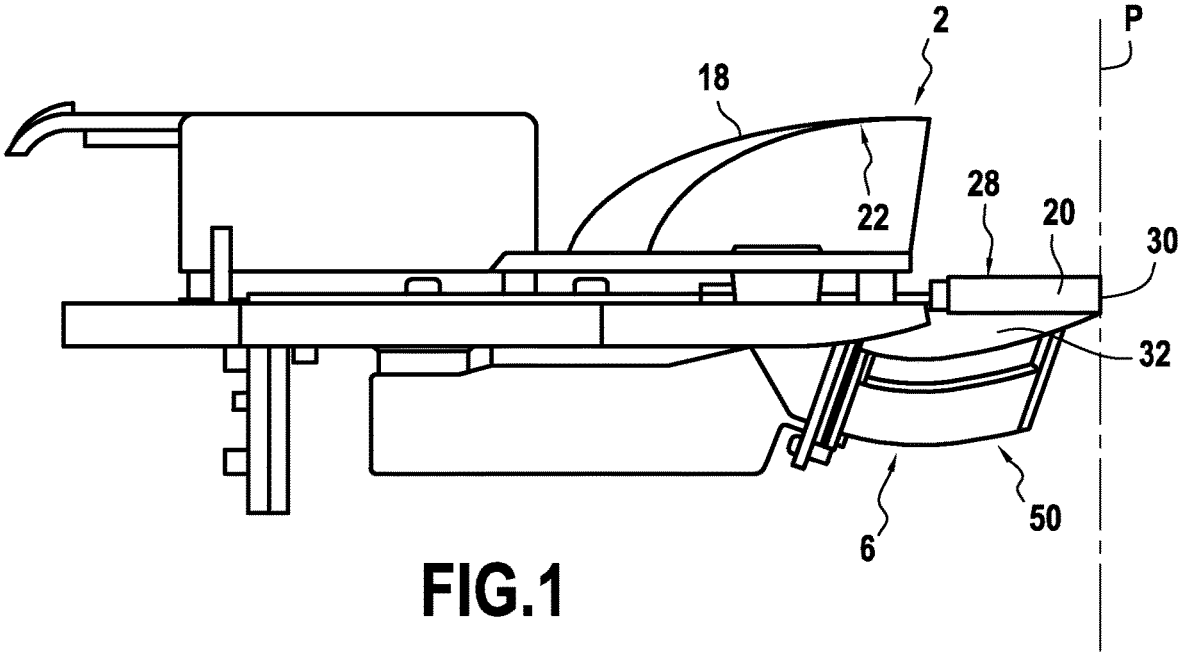
FIG. 1 is a side view of a luminous lighting and/or signaling module, according to the invention, of an automotive vehicle, in which a first submodule is placed above a second submodule, the module furthermore comprising a projecting device not shown in the figure.
Figure 2:
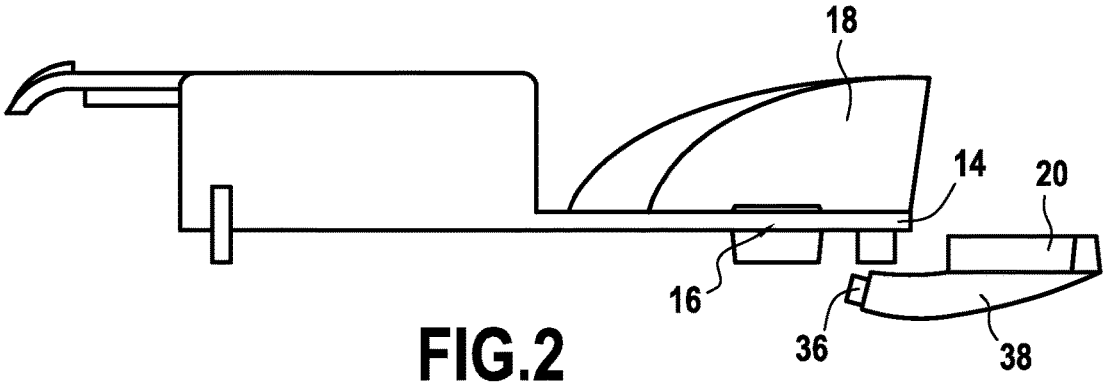
FIG. 2 is a similar view to that in FIG. 1 in which only the first submodule, a shield and an optical guide have been shown.
Figure 3:
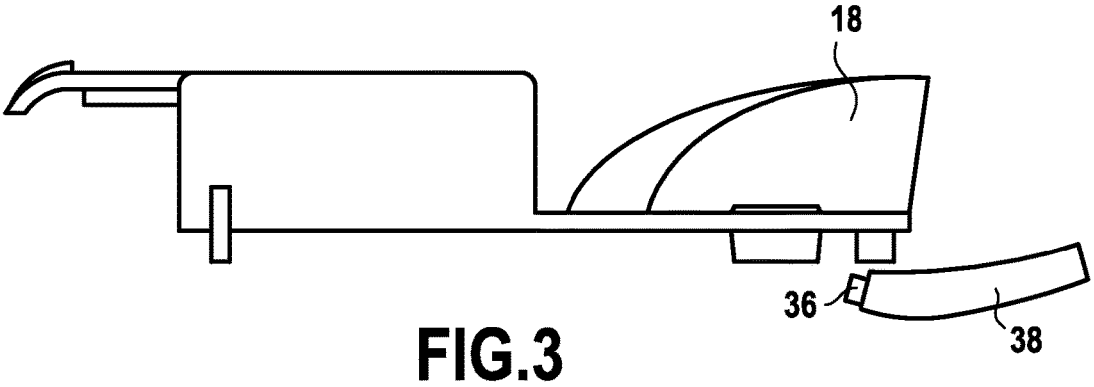
FIG. 3 is a similar view to that in FIG. 2 and in which the shield has been removed.

The optical projecting device 4 has a focal zone, especially a focal plane P represented by dotted lines in FIGS. 1 and 7, and the positions of the various elements of the optical projecting device 4 are set with precision in order to reliably position this focal plane P.

The first means 2 and second means 6 are, in the orientation of the module illustrated in the figures, placed one above the other, thereby respectively forming a first submodule 10 and a second submodule 12 placed in the same housing of the module, and each comprising at least one light source 36 (FIGS. 2, 3, 5 and 6).

The module also comprises a common holder 14 that holds the light sources 36 corresponding to the first and second means 2, 6, the common holder 14 extending between the two submodules 10 and 12. The common holder 14 advantageously forms a means for thermally cooling the light sources 36 placed on either side of this common holder 14.

It will be understood that the module according to the invention may be oriented with an orientation other than that described and illustrated and in which the two submodules 10 and 12 are arranged vertically one above the other. The submodules 10 and 12 could for example be arranged horizontally one beside the other provided that the common holder 14 separates the two submodules 10 and 12.

The first submodule 10 comprises a light source 16 (FIG. 7), a reflector 18 that is able to deviate toward the optical projecting device 4 projecting rays emitted by the light source 16, and an especially reflective shield 20 forming a means for cutting off the beam of rays emitted by the light source 16.

The light source 16 (FIGS. 2 and 7) consists of a semiconductor source, and for example a light-emitting diode fastened to a printed circuit board. In this case, the printed circuit board is fastened to the common holder 14 separating the two submodules 10 and 12.

The reflector 18 is of the elliptical type. It comprises two focal points, an optical axis and a reflective internal surface 22 that is substantially elliptical. The light source 16 emits most of its light energy toward the reflective internal surface 22 and it is placed in the vicinity of the first focal point of the reflector 18. The whole first submodule 10 is arranged so that the second focal point is comprised in the focal plane P (FIG. 7) of the optical projecting device 4, it being understood that it could be, without departing from the scope of the invention, substantially in the vicinity of this focal plane P.

The shield 20 (FIGS. 2 and 7) is located between the reflector 18 and the optical projecting device 4. It consists of a plate that extends parallel to the plane where the two submodules 10 and 12 join, here substantially horizontally. The shield 20 comprises a central reflecting zone 24 (FIG. 5), and means for fastening to the module that are placed laterally to each of the ends 26 of the plate. The central reflecting zone 24 has a reflective upper face 28, a lower face and two longitudinal end edges among which the front edge, which is turned toward the optical projecting device 4, forms a cut-off edge 30 arranged in the vicinity of the second focal point of the reflector 18. The shield 20 thus creates a horizontal cut-off in the beam and in the concentration of rays under this cut-off in order to produce the beam corresponding to the "low beam" mode.

In accordance with what was described above, the cut-off edge 30 is placed in the focal plane P of the optical projecting device 4 (shown in FIG. 7). The cut-off edge 30 has a curved profile, especially having a step shape substantially at the center of the cut-off edge 30. The central reflecting zone 24 is thus composed of two separate portions that are vertically offset one relative to the other, an inclined plane 32, for example inclined by 15° or 45°, connecting them to form the step.

The operating principle of the first lighting submodule 10 is as follows: as the light source 16 is arranged at the first focal point of the reflector 18, most of the rays emitted by the light source 16, represented by solid lines in FIG. 7, after having reflected from the internal face of the reflector 18, are redirected toward the second focal point or the vicinity of the latter. They then pass through the lens 8 (or are reflected from a complementary reflector 18) and exit from the lighting module in a direction substantially parallel to the optical axis.

However, although using a diode allows the light emission to be focused, rays may be emitted on the periphery of the light source 16. Thus, rays may, after having been reflected from the internal face of the reflector 18, pass beyond the cut-off. The role of the shield 20 is to limit the number of these rays by enabling them to be reflected from the reflective upper surface of the shield 20 before they pass through the optical element. It will be understood that without reflection from the shield 20, peripheral rays would not be exploited.

Figure 8:
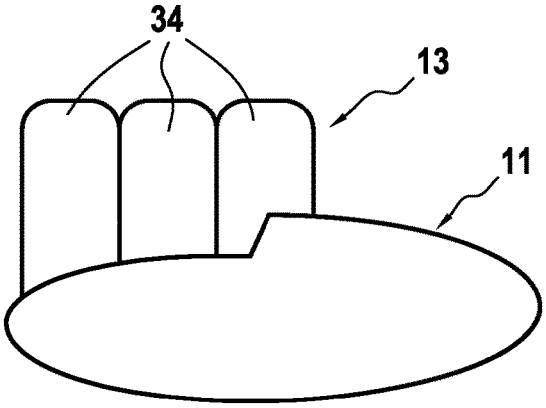
FIG. 8 is a schematic representation of the complementarity of the beams emitted by the submodules of the luminous module according to the invention.

The second submodule 12 is arranged to produce a second beam 13 that is complementary to the first beam 11 produced by the first submodule 10, such as is illustrated in FIG. 8. This complementary second beam 13 here consists of a selective beam allowing a non-dazzling high beam function to be produced. The expression "complementary beam" is understood to mean a beam that forms with the beam produced by the first submodule 10, a unitary beam, when the two submodules 10 and 12 are controlled so as to simultaneously produce the emission of the light beam that is specific thereto.

According to the invention, the second beam 13 emitted by the second submodule 12 is selective, i.e. the second beam 13 is split into a plurality of beam portions 34, which may be turned on or turned off selectively depending on control instructions of the light sources 36 of the second submodule 12. These beam portions 34 may take, immaterially as regards the invention, the shape of right rectilinear bands or indeed, for example, the shape of spots the outline of which is less defined than that of the segments.

The lighting function provided by each beam portion 34 may, in all these cases, be turned off or attenuated to form a zone of non-dazzle of a driver of a vehicle detected in the road scene upstream of the vehicle, while still allowing good lighting conditions to be preserved for the rest of the road scene.

In the following description, the beam portions 34 of the complementary second beam 13 take the form of segments, and more particularly of three beam segments.

The second submodule 12 comprises on the one hand three light sources 36 that are selectively activatable in order to emit, simultaneously or alternatively, light rays, and on the other hand optical guides 38 arranged to interact with the light sources 36 so as to form images of these light sources 36 level with the focal plane P of the optical projecting device 4, so that these images can be projected by the optical projecting device 4 at the exit of the module. Each beam portion or segment 34 is obtained by the interaction of a light source 36 and an associated optical guide 38.

The light sources 36 each consist of a semiconductor source, and for example a light-emitting diode fastened to a printed circuit board. In this case, and as may be the case for the printed circuit board associated with the light-emitting diode of the first submodule 10, the printed circuit board is fastened to the common holder 14 separating the two submodules 10 and 12.

In the illustrated example, and such as will be described below, there are three light sources 36, but it will be understood that provided that at least two selectively activatable light sources 36 are provided it will be possible to form the complementary second beam 13 able to produce a non-dazzling high beam function in which one of the segments 34 of the complementary second beam 13 may be turned off or attenuated in the case of detection of a vehicle in the zone illuminated by this segment 34.

Each optical guide 38 has an entrance face 40 and an exit face 42 so as to guide the light from the entrance face 40 to the exit face 42. The optical guides 38 furthermore comprise a lower face, referred to as the reflective face 44, and an upper face, referred to as the front face 46, that extend between the ends of the entrance face 40 and the exit face 42, the reflective face 44 being turned away from the shield 20 whereas the front face 46 is turned toward the shield 20.

The optical guides 38 are placed so as to make contact with the shield 20. They are oriented so as to make contact with the shield 20 only in the vicinity of the focal plane P of the optical projecting device 4. Such as illustrated, it is the front face 46 of each optical guide 38 that makes contact with the shield 20, the line of contact 48 between each front face 46 and the shield 20 being in the focal plane P.

The reflective face 44 has a substantially elliptical shape, a first focal point of which coincides with the location of the light source 36 and a second focal point of which, referred to as the focus, is located level with the ridge where the front face 46 and the exit face 42 meet, at the point of contact with the shield 20, so that, such as may be seen in FIG. 7, the light rays reflected in the optical guides 38 (which rays are represented by dotted lines) exit from the optical guide 38 mainly at the top of the exit face 42. Some of these rays reach the top portion of the lens 8 directly whereas some others are reflected by a lower face of the shield 20 in order to reach the lower portion of the lens 8 (see the thicker line).

Figure 4:
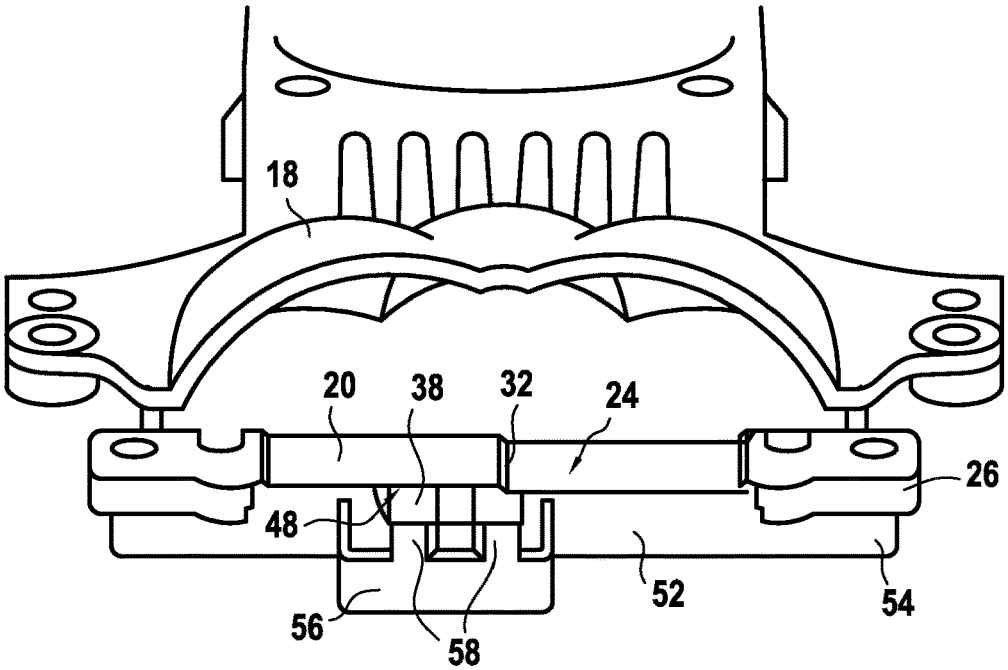
FIG. 4 is a front view, from slightly above, of the module illustrated in FIG. 2.
Figure 6:
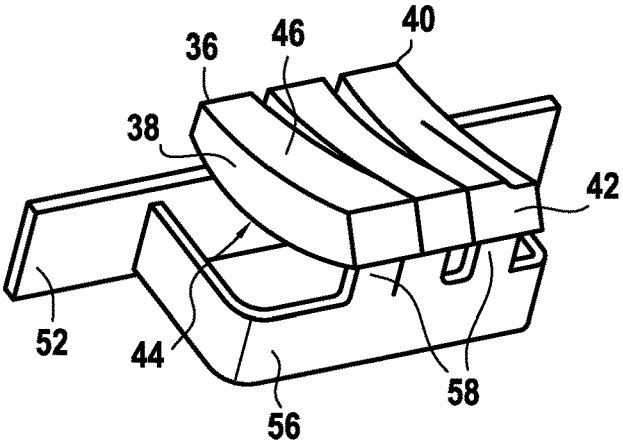
FIG. 6 is a perspective view of the guide and its fastening holder.
Figure 5:
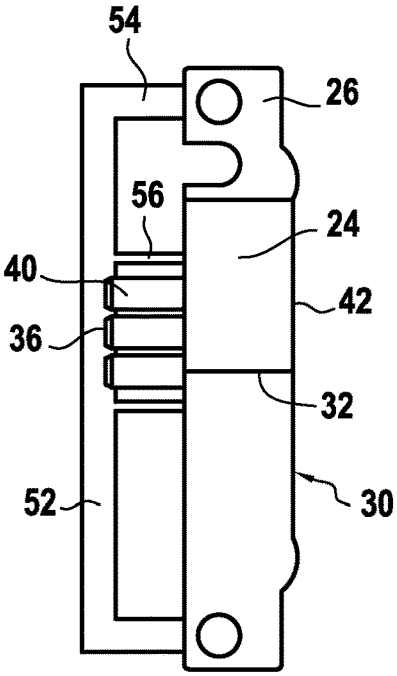
FIG. 5 is a top view of the guide and its fastening holder, and of the shield overlapping the guide.

The optical guides 38 are placed in a transverse series and are identical in number to the light sources 36, each optical guide 38 being placed facing one of these light sources 36. Such as may especially be seen in FIG. 4, the series of three optical guides 38 is placed so as to be offset transversely relative to the center of the module. It will be understood that this transverse offset is here due to the fact that the vehicle has two headlamps, a left headlamp and a right headlamp. The superposition of the two left and right beams must yield a complete complementary high beam. In order to achieve the width of this beam, the optical guides 38 are therefore offset transversely relative to the center of the lens 8 so as to obtain an offset left or right beam, and then the two beams are superposed.

One of the optical guides 38, placed at one of the transverse ends of the series, has an exit face the upper edge of which, i.e. the edge suitable for making contact with the shield, is cropped in order to have a shape interacting with the inclined plane 32 forming the step of the shield 20.

The optical guides 38 are placed in transverse series perpendicular to the emission axis of the rays exiting from the module, and they are placed in a fanned arrangement. The expression "fanned arrangement" is understood to mean an arrangement in which the respective downstream portions of the optical guides 38, which bear the exit faces 42, are adhesively bonded to one another, and the respective upstream portions, which bear the entrance faces 40, are spaced apart transversely from one another.

It will be understood that, in order to allow the light rays to be guided inside the optical guides 38, the latter are made of a material allowing the light rays to be transmitted by internal reflection from the entrance face 40 to the exit face 42. Such a material will for example possibly consist of polycarbonate (PC), polymethyl methacrylate (PMMA), silicone or glass.

Each of the optical guides 38 is produced individually and the optical guides 38 are mounted, one relative to the other, on a fastening holder 50. The optical guides 38 are here fastened to one another, especially by adhesive bonding level with their downstream end portion, corresponding to the exit face 42 of the light rays, and the spacing of the optical guides 38 one relative to the other or to its neighbor or neighbors level with their upstream portion, corresponding to the entrance face 40 of the light rays, is ensured by the fastening of each optical guide 38 to the fastening holder 50.

The fastening holder 50 here takes the form of a transverse strip 52 the transverse ends 54 of which are here fastened to the transverse ends 26 of the shield 20, the transverse strip 52 bearing the optical guides 38 level with their downstream end, and a frame 56 on which tabs 58 that form an integral part of the frame 56 allow the optical guides 38 to be fastened level with their upstream portion.

The downstream portions of the optical guides 38 abut one against the other over a set distance in order to form a zone of overlap. The exit faces 42 of each optical guide 38 being placed substantially in line with the cut-off edge 30 of the shield 20, i.e. substantially in the vicinity of the focal plane P of the optical projecting device 4, it will be understood that the zones of overlap of the images formed by each optical guide 38 are placed upstream of the focal plane P, thereby allowing a complementary beam to be projected, the various portions of which are smoothed in order to avoid a vertical division, in the case of segmentation of the beam, that is too clear.

In one variant (not illustrated) the set of optical guides 38 may be produced from one and only one part, which preserves the fan shape with three entrance faces 40 respectively at a distance from one another and three conduits each leading to a common exit face 42, it being understood that this part will be, as was possibly described above, formed from a material that is transparent to light and that allows light rays emitted by the diodes placed facing the input faces to be transmitted.

The optical guides 38 play the role of means that are complementary to the light sources 36 of the second submodule 12. It should be noted that, according to the invention, the complementary means are arranged in the second submodule 12 so that the images that they form of the light sources 36 have edges placed so as to be adjacent to the profile of the cut-off edge 30. In the case of the optical guides 38 described in the illustrated example, the complementary means make contact with the shield 20. They are oriented so as to make contact with the shield 20 only in the vicinity of the focal plane P.

In one variant embodiment (not shown), the complementary means consist of a phosphor-bearing plate, and the light sources 36 consist of laser diodes oriented so as to illuminate the phosphor borne by the plate. The plate is a glass plate into which are integrated phosphor blocks, the laser diodes being targeted on these phosphor blocks. The plate bearing the phosphor is placed in the focal plane P. The plate has an edge the profile of which is complementary to the profile of the cut-off edge 30 of the shield 20, the phosphor borne by the plate being adjacent to the curved profile of the cut-off edge 30.

According to other variants, the complementary means may be placed a distance away from the shield 20, especially when these complementary means consist of a lens, and/or a reflector, that are arranged so that the rays coming from the light source 36 that they redirect pass in the vicinity of the second focal point of the first submodule 10 in order to form an overall unitary beam on exiting the module.

Whatever the variant embodiment chosen, it is particularly advantageous to provide a lighting system comprising at least two lighting modules such as described above. These modules are distributed so that at least one of the modules is placed in a left headlamp of the vehicle, and at least one of the modules is placed in the corresponding right headlamp. In each headlamp, provision will possibly be made for a plurality of lighting modules. The modules are arranged relative to each other, whether within a given headlamp, or between the two headlamps, so that at least one beam portion, for example one beam segment, produced by one of the modules overlaps at least one beam portion, in the example one beam segment, produced by another of the modules.

The lighting system also comprises control means for turning on, turning off or modifying the luminous power emitted by each light source 36 of each module. These control means will possibly be specific to each module or consist of one control means, provided that each light source 36 of the system may be simultaneously controlled.

The lighting system furthermore comprises a module for detecting on the road a body not to be dazzled. This detecting module for example consists of a video camera turned toward the road scene extending in front of the vehicle, and of associated image processing means, which allow detection information to be produced that the detecting module is able to transmit to the control means in order to allow the luminous power emitted by each light source 36 to be turned on, turned off or modified depending on this detection information.

The above description clearly explains how the invention allows the objectives that were set to be achieved and especially how it makes it possible to produce a luminous module that allows in a given module, and without a movable mechanical part, the non-dazzling high beam lighting function to be combined with a low beam function.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A luminous lighting or signaling module of an automotive vehicle, said luminous lighting or signaling module comprising:

a first submodule arranged to produce a first cut-off beam; and a second submodule arranged to produce at least two selectively activatable luminous segments, wherein said at least two selectively activatable luminous segments form a second beam that is complementary to said first cut-off beam, when they are activated simultaneously, wherein the first submodule is positioned above the second submodule as viewed in a travel direction of the automotive vehicle, wherein in said second submodule, at least two selectively activatable second light sources are able to emit, simultaneously or alternatively, light rays, wherein said second submodule includes a light guide device arranged to interact with said at least two selectively activatable second light sources so as to form images of said at least two selectively activatable second light sources level with a focal zone of a projecting device, said images being intended to be projected by said projecting device in order to form said at least two selectively activatable luminous segments, and wherein said first submodule includes a reflective shield that cuts off a beam of rays emitted by a first light source, the reflective shield positioned above the light guide device of the second submodule.

2. The luminous lighting or signaling module according to claim 1, further comprising said projecting device placed on a path of said first cut-off beam and said second beam, said projecting device comprising said focal zone and a focal plane.

3. The luminous lighting or signaling module according to claim 2, wherein said light guide device comprises optical guides that are respectively associated with said at least two selectively activatable second light sources, each optical guide is positioned to contact the reflective shield only along the focal plane.

4. The luminous lighting or signaling module according to claim 1, wherein said first submodule is arranged to produce a low beam, comprising an oblique cut-off portion.

5. The luminous lighting or signaling module according to claim 4, wherein in said second submodule, at least two selectively activatable second light sources are able to emit, simultaneously or alternatively, light rays.

6. The luminous lighting or signaling module according to claim 4, comprising said first submodule arranged to produce said first cut-off beam and said second submodule arranged to produce said at least two selectively activatable luminous segments; wherein in said second submodule, at least two selectively activatable second light sources are able to emit, simultaneously or alternatively, light rays.

7. The luminous lighting or signaling module according to claim 1, wherein said reflective shield comprises an edge placed in said focal zone of said projecting device.

8. The luminous lighting or signaling module according to claim 2, wherein the reflective shield includes an edge placed in the focal plane, wherein said light guide device is arranged so that said images have edges placed so as to be adjacent to said edge of the reflective shield.

9. The luminous lighting or signaling module according to claim 8, wherein said light guide device comprises optical guides that are respectively associated with one of said at least two selectively activatable second light sources, said each optical guide having an entrance face and an exit face so as to guide the light emitted by the associated second light source from said entrance face to said exit face.

10. The luminous lighting or signaling module according to claim 1, wherein said light guide device is a plate bearing a luminescent material and in that said at least two selectively activatable second light sources are oriented so as to light said luminescent material borne by said plate.

11. The luminous lighting or signaling module according to claim 10, wherein said plate bearing said luminescent material is placed in said focal zone.

12. The luminous lighting or signaling module according to claim 1, wherein said light guide device comprises optical guides that are respectively associated with one of said at least two selectively activatable second light sources, said each optical guide having an entrance face and an exit face so as to guide the light emitted by the associated second light source from said entrance face to said exit face.

13. The luminous lighting or signaling module according to claim 12, wherein said each optical guide is arranged to form an image of the associated second light source level with said exit face of said optical guide, said exit face being placed level with said focal zone of said projecting device.

14. The luminous lighting or signaling module according to claim 13, wherein said optical guides are placed so that their respective downstream portions, which bear said exit face, are contiguous one against the other and so that their respective upstream portions, which bear said entrance face, are spaced transversely one from the other.

15. The luminous lighting or signaling module according to claim 12, wherein said optical guides are placed so that their respective downstream portions, which bear said exit face, are contiguous one against the other and so that their respective upstream portions, which bear said entrance face, are spaced transversely one from the other.

16. The luminous lighting or signaling module according to claim 15, wherein the set of said optical guides is produced from one and only one part.

17. The luminous lighting or signaling module according to claim 16, wherein said downstream portions of two adjacent optical guides join upstream of said focal zone, in order to form a common zone of overlap of the images formed by said of said two adjacent optical guides.

18. The luminous lighting or signaling module according to claim 1, wherein said at least two selectively activatable light sources corresponding to said first submodule and to said second submodule are placed on a common holder that extends between said first submodule and said second submodule.

19. A lighting system comprising at least one luminous lighting or signaling module according to claim 1 and control means for turning on, turning off or modifying the luminous power emitted by said first submodule and said second submodule of said at least one luminous lighting or signaling module.

20. The luminous lighting or signaling module according to claim 1, comprising said first submodule arranged to produce said first cut-off beam and said second submodule arranged to produce said at least two selectively activatable luminous segments; wherein said first submodule is arranged to produce a low beam, especially comprising an oblique cut-off portion.

* * * * *